US009487003B2

(12) United States Patent
Nguyen et al.

(10) Patent No.: US 9,487,003 B2
(45) Date of Patent: Nov. 8, 2016

(54) CONTACT-TYPE PATTERNING DEVICE

(71) Applicant: Enjet Co., Ltd., Gyeonggi-do (KR)

(72) Inventors: Vu Dat Nguyen, Gyeonggi-do (KR); Do-Young Byun, Seoul (KR); Yong Hee Jang, Gyeonggi-do (KR)

(73) Assignee: ENJET CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/910,783

(22) PCT Filed: Aug. 6, 2014

(86) PCT No.: PCT/KR2014/007268
§ 371 (c)(1),
(2) Date: Feb. 8, 2016

(87) PCT Pub. No.: WO2015/020425
PCT Pub. Date: Feb. 12, 2015

(65) Prior Publication Data

US 2016/0185112 A1 Jun. 30, 2016

(30) Foreign Application Priority Data

Aug. 6, 2013 (KR) ..... 10-2013-0093163

(51) Int. Cl.
*B41J 2/06* (2006.01)
*B41J 2/035* (2006.01)

(52) U.S. Cl.
CPC *B41J 2/06* (2013.01); *B41J 2/035* (2013.01); *B41J 2002/061* (2013.01); *B41J 2002/062* (2013.01); *B41J 2002/063* (2013.01)

(58) Field of Classification Search
None
See application file for complete search history.

(56) References Cited

U.S. PATENT DOCUMENTS 7,344,756 B2 3/2008 Mirkin et al.
8,705,114 B2 * 4/2014 Byun ..... B41J 2/06 347/112
2010/0222771 A1 9/2010 Mitchell et al.

FOREIGN PATENT DOCUMENTS

KR 10-0330945 B1 4/2002
KR 10-2010-0060226 6/2010

OTHER PUBLICATIONS

International Search Report in International Application No. PCT/KR2014/007268, filed Aug. 6, 2014.
A study on Novel electrohydrodynamic (EHD) nano-inkjet heads and printing system (Doctor's degree theses, Aug. 2011).

* cited by examiner

*Primary Examiner* — Lisa M Solomon
(74) *Attorney, Agent, or Firm* — Saliwanchik, Lloyd & Eisenschenk

(57) ABSTRACT

Provided herein is a contact patterning apparatus comprising: a substrate; a fluid supply unit configured to supply fluid towards the substrate; a voltage applying unit electrically connected to the fluid supply unit, and configured to make the fluid from the fluid supply unit connected between the substrate and the fluid supply unit by applying a voltage to a surface of the fluid; and a control unit configured to adjust a level of the voltage being applied to the fluid such that the fluid is patterned on the substrate in a dots form or a continuous line form, thereby stably patterning a continuous line of a fine line width regardless of the viscosity of the fluid being used and the patterning velocity.

20 Claims, 11 Drawing Sheets

(High viscosity : 10,000 cP)

(Low viscosity: 1,000 cP)

CONTACT-TYPE PATTERNING DEVICE

CROSS-REFERENCE TO RELATED APPLICATIONS

This application is the U.S. national stage application of International Patent Application No. PCT/KR2014/007268, filed Aug. 6, 2014, which claims priority to Korean Application No. 10-2013-0093163, filed Aug. 6, 2013, the disclosures of each of which are incorporated herein by reference in their entirety.

BACKGROUND

1. Field

The following description relates to a contact patterning apparatus, and more particularly, to a contact patterning apparatus wherein a contact retention force between a substrate and a fluid is improved through a voltage being applied to the fluid between the substrate and a fluid supply unit, thereby stably forming a line pattern of a fine line width regardless of the viscosity of the fluid being used and of the patterning velocity.

2. Description of Related Art

Recently, a lot of studies are being conducted on methods for forming a fine pattern to be used in LCDs, touch screen panels and the like.

Etching technique such as light exposure is a conventional technique for forming such a fine pattern. However, etching technique needs to keep the space for performing the etching under a vacuum state, and thus leads to a problem of too much manufacturing time and cost.

In order to resolve this problem, in recent days, studies are being conducted on inkjet printing method of forming a pattern by spraying ink on an object.

This inkjet printing method is advantageous in that it forms a pattern by spraying on an object an ink that includes an electrode material and thus significantly saves the manufacturing cost, but there occurs a problem that it is difficult to form a pattern of a fine line width with an ink having a high viscosity.

Meanwhile, there have been studies conducted on contact printing to enable an ink being provided from a nozzle to directly contact an object so as to realize a fine line width based on the inkjet printing technique.

The most representative one of those studies is U.S. Pat. No. 7,344,756.

However, in such a contact printing method, if the patterning velocity is increased, the ink becomes unable to maintain the contact state with the object, and thus snaps, leaving disconnected areas. Such difficulty in patterning a continuous line makes it difficult to adjust the patterning velocity, which is a problem.

SUMMARY

Therefore, a purpose of the present disclosure is to resolve the aforementioned problems of prior art, that is, to provide a contact patterning apparatus that is capable of patterning a fine line width stably and continuously regardless of the viscosity of the fluid used and the patterning velocity.

According to an aspect of the present disclosure, there is provided a contact patterning apparatus comprising: a substrate; a fluid supply unit configured to supply fluid towards the substrate; a voltage applying unit electrically connected to the fluid supply unit, and configured to make the fluid from the fluid supply unit connected between the substrate and the fluid supply unit by applying a voltage to a surface of the fluid; and a control unit configured to adjust a level of the voltage being applied to the fluid such that the fluid is patterned on the substrate in a dots form or a continuous line form.

Herein, the substrate and the fluid supply unit may be arranged such that they are movable, and the control unit may control the fluid to form a meniscus at one end of the fluid supply unit and selectively controls the fluid to be connected or disconnected between the substrate and the fluid supply unit when the substrate or the fluid supply unit moves, by adjusting the level of the voltage being applied from the voltage applying unit.

Herein, wherein the control unit may be configured to adjust the voltage being applied from the voltage applying unit such that an electric stress generated on a surface of the meniscus, a surface tension generated on the surface of the meniscus, and a friction force generated by a viscosity between the substrate and the meniscus are interacted with one another, thereby the fluid being patterned on the substrate in a dots form or a continuous line form.

Herein, the apparatus may further include a first transfer unit configured to transfer the fluid supply unit towards or away from the substrate, or in parallel to the substrate, wherein the control unit further comprises a first velocity control module configured to control a movement velocity of the first transfer unit.

Herein, the apparatus may further include an image acquisition unit configured to store three-dimensional surface information of the substrate, wherein the control unit further comprises a transfer control module configured to receive the surface information of the substrate from the image acquisition unit and to control a movement of the first transfer unit.

Herein, the apparatus may further include a second transfer unit configured to move the substrate, wherein the control unit further comprises a second velocity control module configured to control a movement velocity of the second transfer unit.

Herein, the fluid supply unit may be a nozzle configured to spray the fluid in an electrohydrodynamic inkjet method.

Herein, the fluid supply unit may have an internal diameter of not more than 100 μm, and the distance between the fluid supply unit and the substrate may be not more than 50 μm.

Herein, the fluid supply unit may be provided with a plate; and a nano tip installed in a lower part of the plate, and of which the cross-section decreases towards a lower side of the nano tip.

Herein, a through-groove may be formed on an upper surface of the nano tip, and the plate may be provided with a horizontal flow path that is internally-recessed from an upper surface of the plate and that is connected to the through-groove.

Herein, the nano tip may be installed at one end of the plate, the plate may be provided with a horizontal flow path that is inwardly-recessed from an upper surface of the plate and that extends to the end of the plate, and the nano tip may be provided with a vertical flow path that is inwardly-recessed from an exterior surface of the nano tip and that is connected to the fluid flow path and extends to the lower end.

Herein, the apparatus may further include a case unit configured to accommodate therein the substrate and the fluid supply unit.

Herein, the apparatus may further include a gas storage configured to supply at least one of nitrogen and inert gas to the inside of the case unit.

Herein, the distance between the fluid supply unit and the substrate may be not more than 0.5 times the diameter of the meniscus.

The present disclosure has an effect of providing a contact patterning apparatus capable of selectively forming a line pattern in a dots form or a in a continuous form.

Furthermore, according to the present disclosure, it is possible to selectively form a line pattern in a dots form or in a continuous form by adjusting the level of the voltage being applied from a voltage applying unit according to the transferring velocity of the substrate or the fluid supply unit.

Furthermore, according to the present disclosure, it is possible to selectively form a line pattern in a dots form or in a continuous form by adjusting the level of the voltage being applied from a voltage applying unit according to the viscosity of the fluid being supplied to the fluid supply unit.

DETAILED DESCRIPTION

Figure 1:
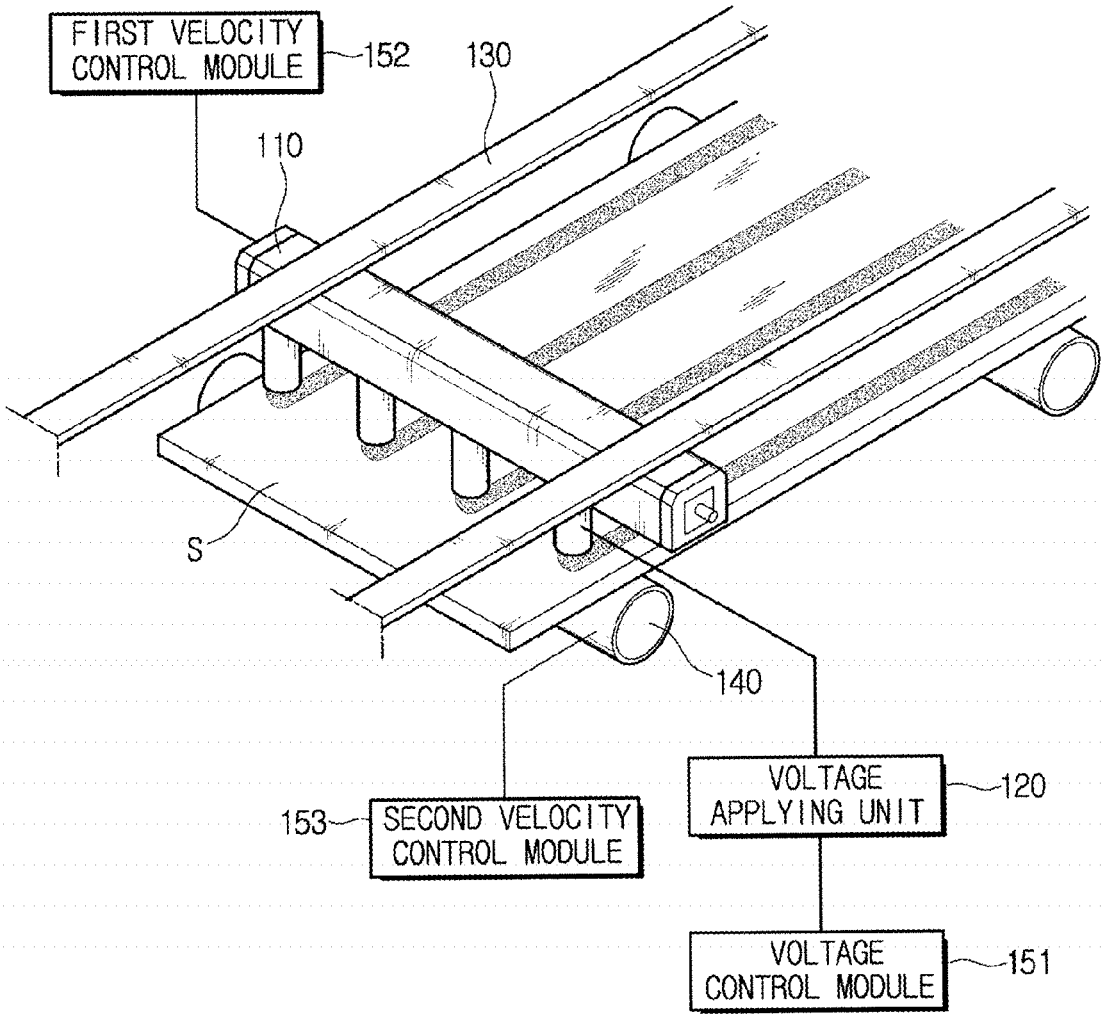
FIG. 1 is a perspective view schematically illustrating a contact patterning apparatus according to an embodiment of the present disclosure.

Components that are configured the same in various embodiments will be explained with reference to the first embodiment using the same reference numerals, and only the components that are configured differently will be explained with reference to other embodiments.

Hereinafter, a contact patterning apparatus according to a first embodiment of the present disclosure will be explained with reference to the attached drawings.

FIG. 1 is a perspective view schematically illustrating a contact patterning apparatus according to a first embodiment of the present disclosure.

Referring to FIG. 1, the contact patterning apparatus according to the first embodiment 100 is capable of patterning a continuous line as a fluid being provided through a fluid supply unit maintains its contact state with a substrate. This contact patterning apparatus 100 includes a fluid supply unit 110, a voltage applying unit 120, a first transfer unit 130, a second transfer unit 140, and a control unit 150.

The fluid supply unit 110 is configured to supply a fluid from an end (hereinafter referred to as 'discharge unit 111') that faces a substrate (S). As the fluid contacts the substrate (S), a connecting relationship is formed between the fluid supply unit 110, followed by the fluid and then the substrate (S) sequentially.

Meanwhile, the fluid supply unit according to the first embodiment of the present disclosure 110 may be realized as a nano tip or a nozzle configured to spray the fluid in an electrohydrodynamic method. But, this is not limited to the above.

However, the first embodiment of the present disclosure is based on an assumption that the fluid supply unit 110 is a nozzle.

Meanwhile, if the fluid supply unit 110 is realized as a nozzle that sprays a fluid in the electrohydrodynamic method, the fluid is supplied towards the discharge unit 111, and then the fluid, forming a meniscus (M) state, contacts the substrate (S) based on the voltage being applied from the voltage applying unit 120.

Herein, the contact between the meniscus (M) and the substrate (S) may be made by either forming a meniscus (M) at the discharge unit 111 side first and then transferring the fluid supply unit 110 towards the substrate (S) by means of the first transfer unit 130 to contact the substrate (S); or by transferring the fluid supply unit 110 and the substrate (S) close to each other first and then forming a meniscus (M) while at the same time making the fluid supply unit 110 and the substrate (S) contact each other. But, this is not limited to the above.

Meanwhile, the distance between the fluid supply unit 110 and the substrate (S) may vary depending on the diameter of the discharge unit 111, viscosity and surface tension of the fluid, and the like, but it is desirable to move the fluid supply unit 110 and the substrate (s) close to each other such that they are distanced by not more than 50 μm. But, this is not limited to the above.

When the first transfer unit 130 or second transfer unit 140 moves as will be explained hereinafter, this meniscus (M) will move a shorter distance than the distance moved by the first transfer unit 130 or second transfer unit 140 due to the friction force caused by the viscosity between the substrate (S) and the fluid, and therefore, the meniscus (M) will be transformed into a long drooping form and will maintain the contact state with the substrate (S).

Such transformation of the form of the meniscus (M) will be explained in detail hereinafter.

Meanwhile, in the first embodiment of the present disclosure, a plurality of fluid supply units 110 are formed that are distanced from one another so as to pattern a plurality of line patterns simultaneously. But, this is not limited to the above.

Figure 3A:
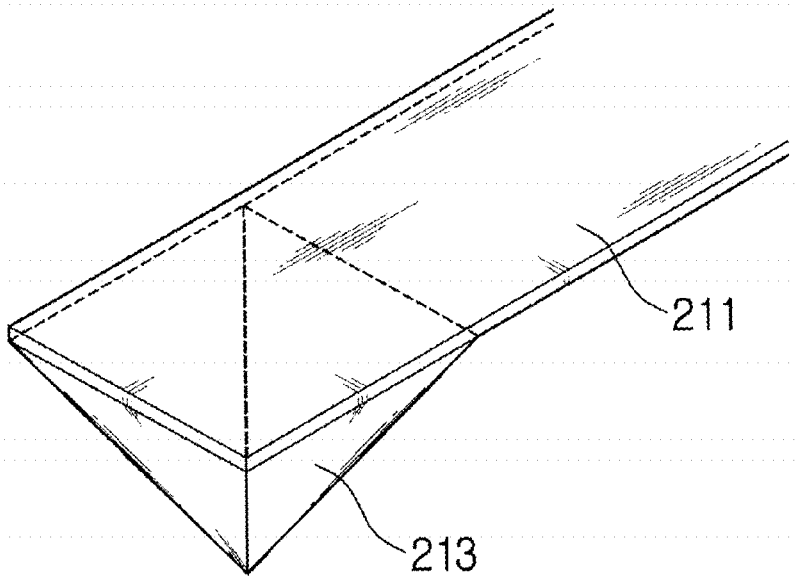
FIG. 3 are perspective views illustrating modified examples of a fluid supply unit realized as a nano tip in the contact patterning apparatus of FIG. 1.
Figure 3B:
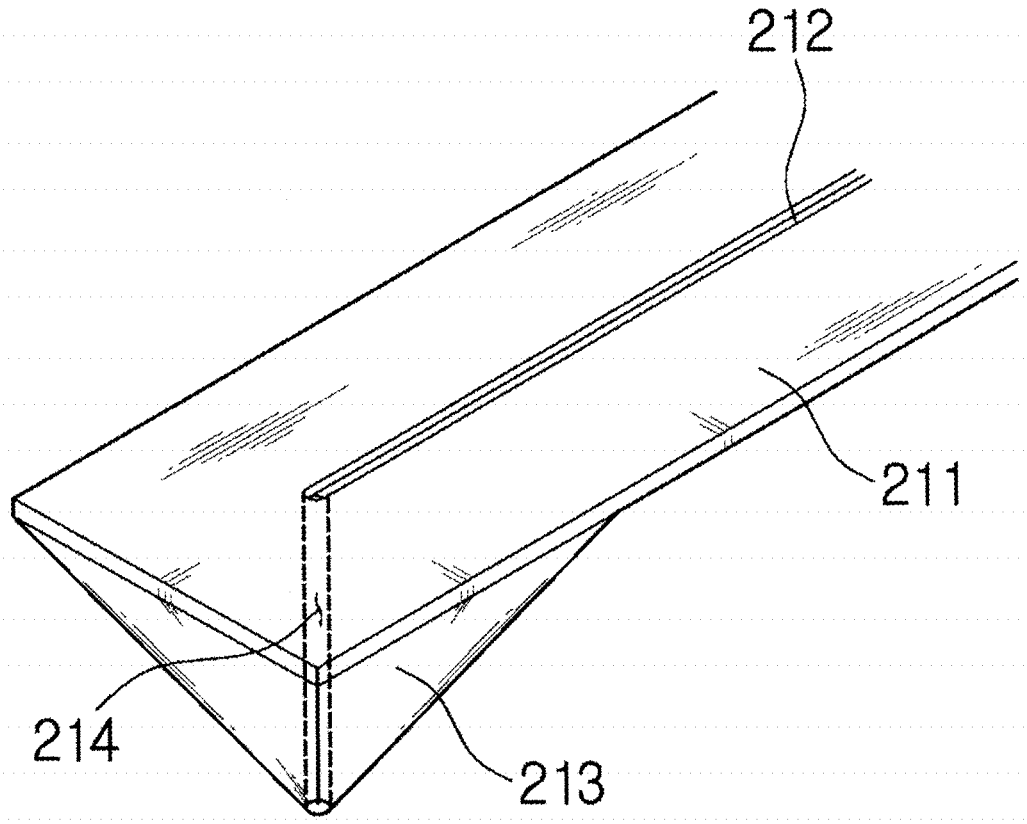
Figure 3C:
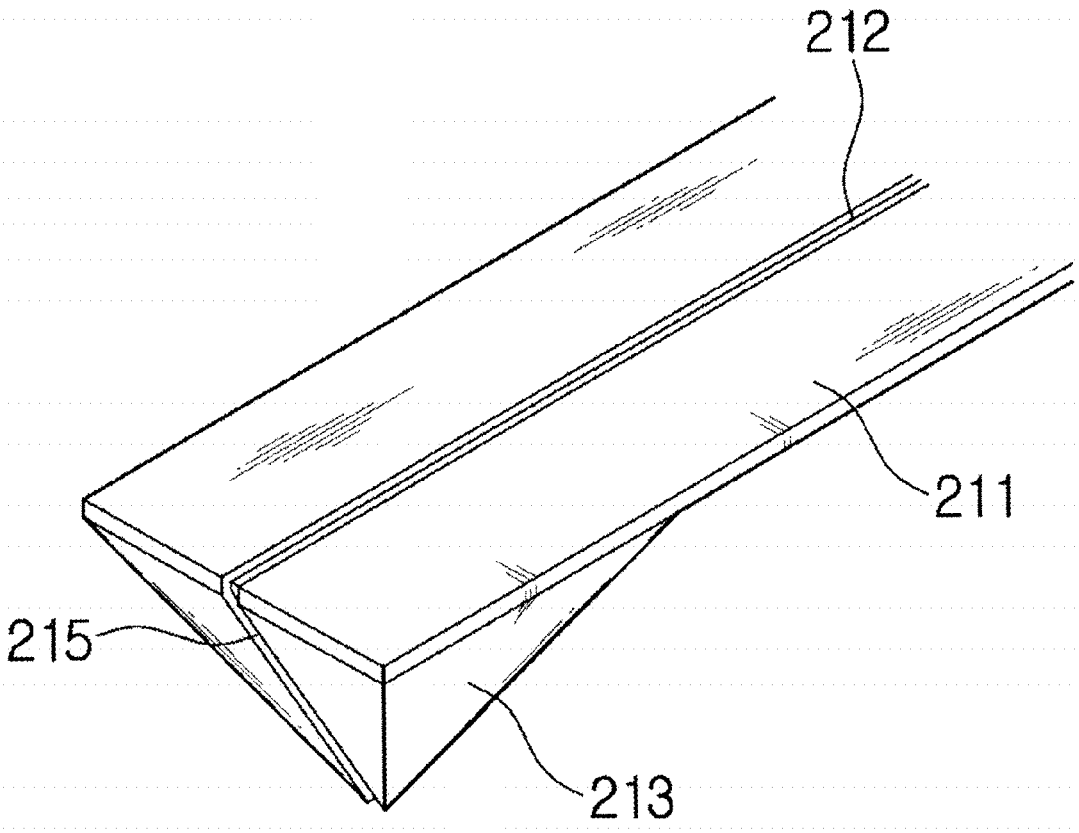

FIG. 3 are perspective views illustrating modified examples of a fluid supply unit realized as a nano tip in the contact patterning apparatus of FIG. 1.

Referring to FIG. 3, a fluid supply unit 210 may include a plate 211 and a nano tip 213.

The plate 211 is a panel-shaped component extending in one direction, and is provided with a horizontal flow path 212 that extends along a longitudinal direction of the plate 211 on an upper surface of the plate 211. The fluid to be patterned on the substrate (S) flows along this path.

The nano tip 213 is what serves as the discharge unit 111 in the case where the fluid supply unit 210 is realized as a nozzle, as mentioned above. The nano tip 213 is installed on a lower part of the plate 211, so that the fluid flowing along the plate 211 may reach the lower end of the nano tip 213, thereby forming a meniscus (M) at a lowermost end of the nano tip 213.

Herein, in order for the nano tip 213 to receive the fluid from the plate 211, a through-groove 214 may be formed on an area of the nano tip that corresponds to the horizontal flow path 212 and the through-groove 214 is configured to penetrate the upper surface and lowermost end of the nano tip 213 so as to receive the fluid from the horizontal flow path 212.

However, instead of forming the through-groove 214, the fluid may be delivered to the lowermost end of the nano tip 213 by the nano tip 213 installed on a lower portion of one end of the plate 211, the horizontal flow path 212 extending to the one end of the plate 211, and a vertical flow path 215 inwardly-recessed from a front face of the nano tip 213 and connected to the horizontal flow path 212 and to the lowermost end of the nano tip 213. But, this is not limited to the above. Otherwise, instead of forming the aforementioned configuration, it is also possible to make the fluid contact the lowermost end of the nano tip 213, and then transfer the nano tip 213 towards the substrate (S) to conduct patterning.

The voltage applying unit 120 is electrically connected to the fluid supply unit 110 to apply a voltage to the fluid supply unit 110.

Herein, the voltage being applied to the fluid supply unit 110 is transmitted to a surface of the fluid, and generates an electric stress that could connect the substrate (S) and the fluid supply unit 110 even when the shape of the fluid changes as the first transfer unit 130 or second transfer unit 150 moves as will be explained hereinafter.

That is, the surface tension generated on the surface of the fluid and the friction force between the substrate (S) and the fluid caused by the viscosity of the fluid may form a state of the fluid being connected between the substrate (S) and the fluid supply unit 110, and this state of the fluid being connected between the substrate (S) and the fluid supply unit 110 can be maintained by the electric stress provided by the voltage applied from the voltage applying unit 120.

The first transfer unit 130 is provided on an upper side of the fluid supply unit 110, and transfers the fluid supply unit 110 towards or away from the substrate (S) or along a virtual plane that is parallel to the substrate (S).

That is, on an assumption that the direction in which the fluid supply unit 110 moves towards or away from the substrate (S) is defined as z axis, and the movement on the virtual plane parallel to the substrate (S) is defined as an x axis or y axis movement, the first transfer unit 130 transfers the fluid supply unit 110 in at least one direction of the x axis, y axis, and z axis.

The second transfer unit 140 is provided on a lower side of the substrate (S), and transfers the substrate (S) along the virtual plane parallel to the substrate (S).

That is, on an assumption that a movement on the virtual plane parallel to the substrate (S) is defined as an x axis or y axis movement, the second transfer unit 140 transfers the substrate (S) in at least one direction of the x axis and y axis.

Figure 2:
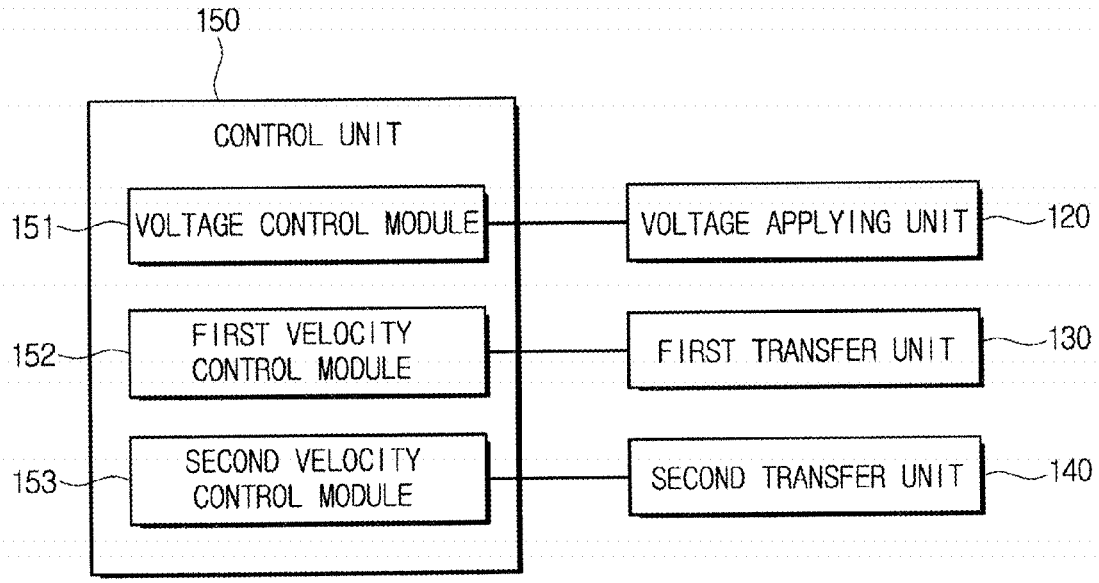
FIG. 2 is a conceptual view schematically illustrating a control unit in the contact patterning apparatus of FIG. 1.

FIG. 2 is a conceptual view schematically illustrating a control unit in the contact patterning apparatus of FIG. 1.

Referring to FIG. 2, the control unit 150 is configured to adjust the level of the voltage being applied from the voltage applying unit 120 such that the fluid provided from the discharge unit 111 may be patterned in a continuous line form. Such a control unit 150 includes a voltage control module 151.

That is, as mentioned above, for the fluid being provided from the discharge unit 111 to maintain its contact state with the substrate (S), the level of the voltage being applied from the voltage applying unit 120 plays a significant effect, and thus it is important to adequately control the level of the voltage through the control unit.

Meanwhile, since adjusting the level of the voltage being applied from the voltage applying unit 120 depends on the relative velocity between the substrate (S) and the fluid supply unit 110, it is necessary to further control the movement of the first transfer unit 130 or second transfer unit 140. The first embodiment of the present disclosure further includes a first velocity control module 152 and a second velocity control module 153. But, this is not limited to the above.

The voltage control module 151 adjusts the level of the voltage being applied from the voltage applying unit 120 so that a meniscus (M) may be formed at the discharge unit 111 side, and adjusts the level of the voltage being applied to the fluid supply unit 110 so that the meniscus (M) does not snap between the substrate (S) and the fluid supply unit 110.

Especially, in the case of using a fluid of a high viscosity, it is very difficult for the fluid to form a meniscus (M) from the discharge unit 111 due to the viscosity and surface tension, and thus it is important to use an adequate voltage applied from the voltage applying unit 120 to form the meniscus (M).

Herein, using the voltage to adjust the level, shape, and the like of the meniscus (M) is a well known technique, and thus detailed explanation will be omitted herein.

Meanwhile, the voltage control module 151 adequately controls the level of the voltage such that the fluid is connected between the substrate (S) and the fluid supply unit 110 when the substrate (S) or the fluid supply unit 110 is moved by the first transfer unit 130 or second transfer unit 140.

The force acting on the fluid as the substrate (S) or the fluid supply unit 110 moves is the friction force caused by the viscosity, the surface tension, and the electric stress caused by the voltage applied to the surface of the fluid. It is the interaction between these three forces by which the fluid maintains its contact state between the substrate (S) and the fluid supply unit 110, thereby patterning a continuous line pattern. This will be explained in greater detail hereinafter.

The first velocity control module 152 controls the transferring velocity of the first transfer unit 130, that is the movement velocity of the fluid supply unit 110. As aforementioned, in order to maintain a continuous line pattern, the pattern velocity, viscosity of the fluid and the level of the voltage being applied to the surface of the fluid must be adjusted, and herein it is the first velocity control module 152 that engages in controlling the patterning velocity.

That is, in the first embodiment of the present disclosure, the movement velocity of the fluid supply unit 110 made by the first transfer unit 130 is almost the same as the patterning velocity, and controlling the transferring velocity of the first transfer unit 130 by the velocity control module 152 controls the patterning velocity.

The second velocity control module 153 controls the transferring velocity of the second transfer unit 140, that is, the movement velocity of the substrate (S). In the first embodiment of the present disclosure, the transferring velocity of the substrate (S) by the second transfer unit 130 is almost the same as the patterning velocity, and controlling the transferring velocity of the second transfer unit 140 through the second velocity control module 153 controls the patterning velocity.

Meanwhile, a case unit (not illustrated) may be further included configured to accommodate therein the substrate (S), the fluid supply unit 110, the first transfer 130 and the second transfer unit 140.

The case unit (not illustrated) may provide a more improved patterning environment as it seals the operation environment from outside during a patterning operation. But, this is not limited to the above.

Furthermore, the case unit (not illustrated) may further include a gas storage (not illustrate) for supplying nitrogen or inert gas towards inside the case unit. But, this is not limited to the above.

Hereinafter, explanation will be made on operating the aforementioned contact patterning apparatus according to a first embodiment of the present disclosure.

Figure 4:
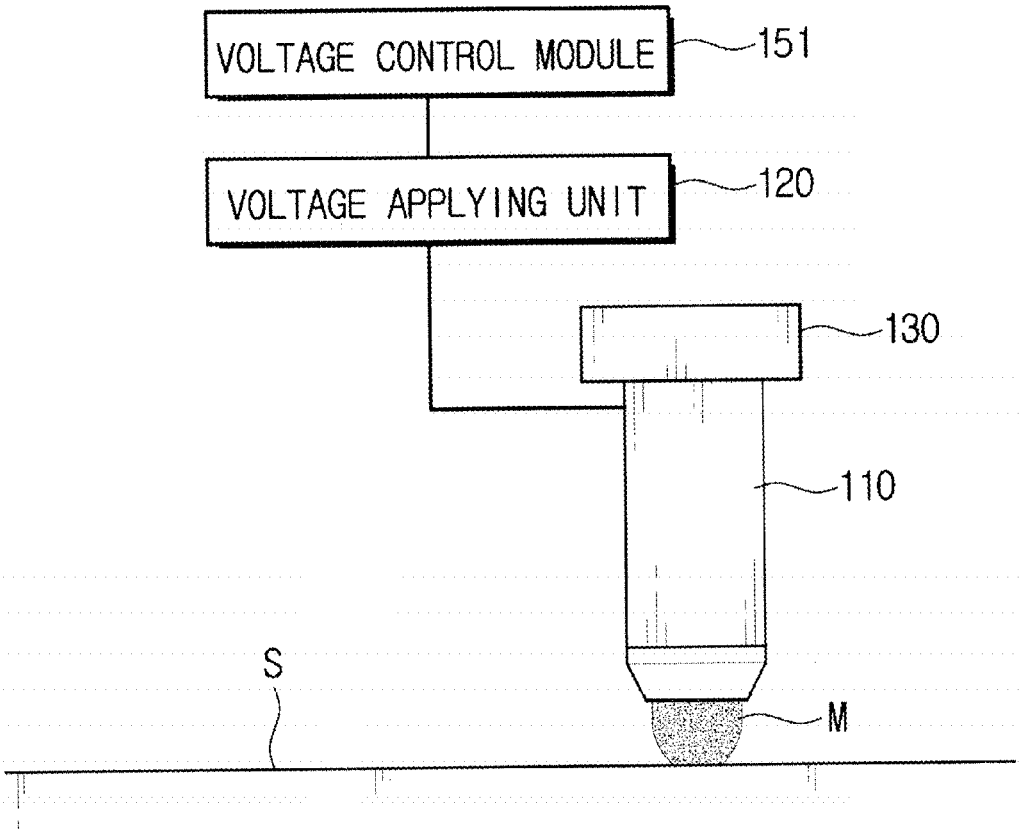
FIG. 4 is a front view schematically illustrating a meniscus in the contact patterning apparatus of FIG. 1.
Figure 5:
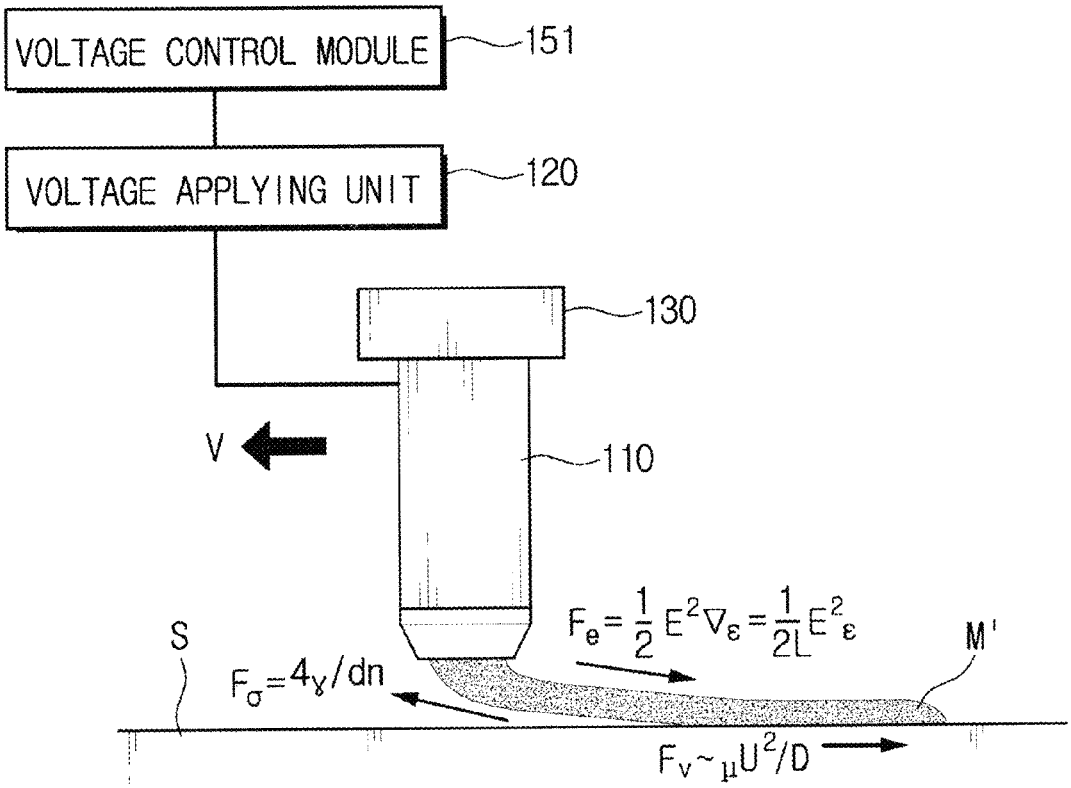
FIG. 5 is a front view schematically illustrating a line pattern being formed while maintaining a contact state between a substrate and a meniscus in the contact patterning apparatus of FIG. 1.

FIG. 4 is a front view schematically illustrating a meniscus being formed in the contact patterning apparatus of FIG. 1, and FIG. 5 is a front view schematically illustrating a line pattern being formed while maintaining a contact state between the substrate and meniscus in the contact patterning apparatus of FIG. 1.

Referring to FIG. 4, a voltage is applied to the fluid supply unit 110, desirably to a surface of the fluid, by the voltage applying unit 120, to form the fluid being provided from the discharge unit 111 into a meniscus (M) having a convex shape.

When forming a meniscus (M), in consideration of the viscosity of the fluid being provided from the fluid supply unit 110, the voltage control module 151 selects an adequate level of the voltage being provided from the voltage applying unit 120 to control the fluid to form a meniscus (M) at the discharge unit 111 side.

Meanwhile, the correlation between the viscosity of the fluid and the level of the voltage needed to form a meniscus (M) is a well known technique, and thus detailed explanation will be omitted herein.

However, in consideration of the size of the meniscus (M) to be formed at the discharge unit 111 side, it is advantageous to arrange the distance between the substrate (S) and the fluid supply unit 110 to be not more than ½ of the size of the meniscus (M) to be formed at the discharge unit 111 side in order to pattern a continuous line. If the distance between the substrate (S) and the fluid supply unit 110 is above ½ of the size of the meniscus (M), a disconnected section may occur in the patterning.

Furthermore, the discharge unit 111 of the fluid supply unit 110 generally used in micro patterning may have an internal diameter of not more than 100 μm, and although it is desirable to distance the substrate (S) and the fluid supply unit 110 from each other by not more than 50 μm, there is no limitation thereto.

However, when forming a meniscus (M), the first transfer unit 130 may be operated to transfer the fluid supply unit 110 towards the substrate (S) so that the fluid supply unit 110 contacts the substrate (S) at the same time as a meniscus (M) is formed from the discharge unit 111. Otherwise, a meniscus (M) may be formed first at the discharge unit 111 of the fluid supply unit 110, and then the fluid supply unit 110 may be transferred towards the substrate (S) by the first transfer unit 130 to contact the substrate (S). However, there is no limitation to any of the aforementioned.

Referring to FIG. 5, while the meniscus (M) is at a contact state with the substrate (S), the first transfer unit 130 or second transfer unit 140 is transferred in a direction parallel to the substrate (S), thereby performing a patterning.

Herein, in the case where the fluid to be used in the patterning is predetermined, the viscosity of the fluid is a constant number, and thus the variables for maintaining the continuity of a line being patterned would be the patterning velocity and the level of the voltage being applied from the voltage applying unit. As aforementioned, the patterning velocity may be adjusted by controlling the movement velocity of the fluid supply unit 110 or the substrate (S) through the first velocity control module 152 or second velocity control module 153.

Meanwhile, depending on the movement of the fluid supply unit 110 or the substrate (S), the voltage control module 151 adjusts the level of the voltage being applied from the voltage applying unit 120 to the surface of the fluid such that the fluid maintains its contact state with the substrate (S) while preventing a disconnection between the substrate (S) and the fluid supply unit 110, thereby patterning a continuous line.

Herein, the principle that prevents disconnection of the fluid between the substrate (S) and the fluid supply unit 110 may be explained by an equilibrium of the friction force between the substrate (S) and the fluid caused by the viscosity of the fluid, the surface tension of the fluid, and the electric stress caused by the voltage being applied to the fluid, that is, an equilibrium of three forces.

Referring to FIG. 5, when a voltage is not applied to the fluid supply unit 110, the surface tension (Fσ) and the friction force (Fu) caused by the viscosity of the fluid act on the meniscus (M), each of which may be expressed as in the math equation below.

$$F_\sigma = \frac{4\gamma}{dn}$$

$$f_\upsilon = \mu\frac{U^2}{D}$$

Herein, γ indicates the surface tension coefficient of the fluid, do the diameter of the nozzle, μ the viscosity of the fluid, U the movement velocity of the fluid supply unit 110, and D the distance between the fluid supply unit 110 and the substrate (S).

The aforementioned surface tension (Fσ) and the friction force (Fu) caused by the viscosity form an equilibrium equation with the ΔP (hydrostatic pressure) of the fluid, as shown below.

$$xP - \frac{4\gamma}{dn} + \mu\frac{U^2}{D} = 0$$

Herein, the balance equation for the flow rate (Q) of the fluid being provided from the fluid supply unit 110 is expressed as below.

$$Q = \frac{\pi dn^4}{128\ \mu L}\left(xP - \frac{4\gamma}{dn} + \mu\frac{U^2}{D}\right)$$

Herein, L indicates the length of the fluid supply unit 110.

That is, when a voltage is not applied to the fluid supply unit 110, a patterning is performed while satisfying the above equilibrium equation for the flow rate (Q).

Herein, when a voltage is applied to the fluid supply unit 110, an electric force (Fe) acts on the meniscus (M) besides the surface tension (Fσ) and the friction force caused by the viscosity of the fluid, as shown below.

$$F_e = \frac{1}{2}E^2 y_\varepsilon = \frac{1}{2L}E_\varepsilon^2$$

Herein, E indicates the level of the voltage being applied, and ∈ the dielectric constant of the fluid.

By the aforementioned electric force (Fe), the equilibrium equation and balance equation end up as below.

$$xP - \frac{4\gamma}{dn} + \mu\frac{U^2}{D} + \frac{E_\varepsilon^2}{2} = 0$$

$$Q = \frac{\pi dn^4}{128\ \mu L}\left(xP - \frac{4\gamma}{dn} + \mu\frac{U^2}{D} + \frac{E_\varepsilon^2}{2}\right)$$

That is, an important factor that affects the patterning velocity in the case of performing a contact patterning is the flow rate (Q) of the fluid supply unit 110. With no voltage applied, the flow rate is determined simply by the hydrostatic pressure, but when a voltage is applied, this voltage serves to increase the flow rate (Q). Therefore, even when the patterning velocity is increased, the fluid surface of the meniscus (M) is tensioned, and thus a continuous line patterning may be ensured.

Hereinafter, a patterning experiment conducted based on the aforementioned will be explained.

Figure 6:
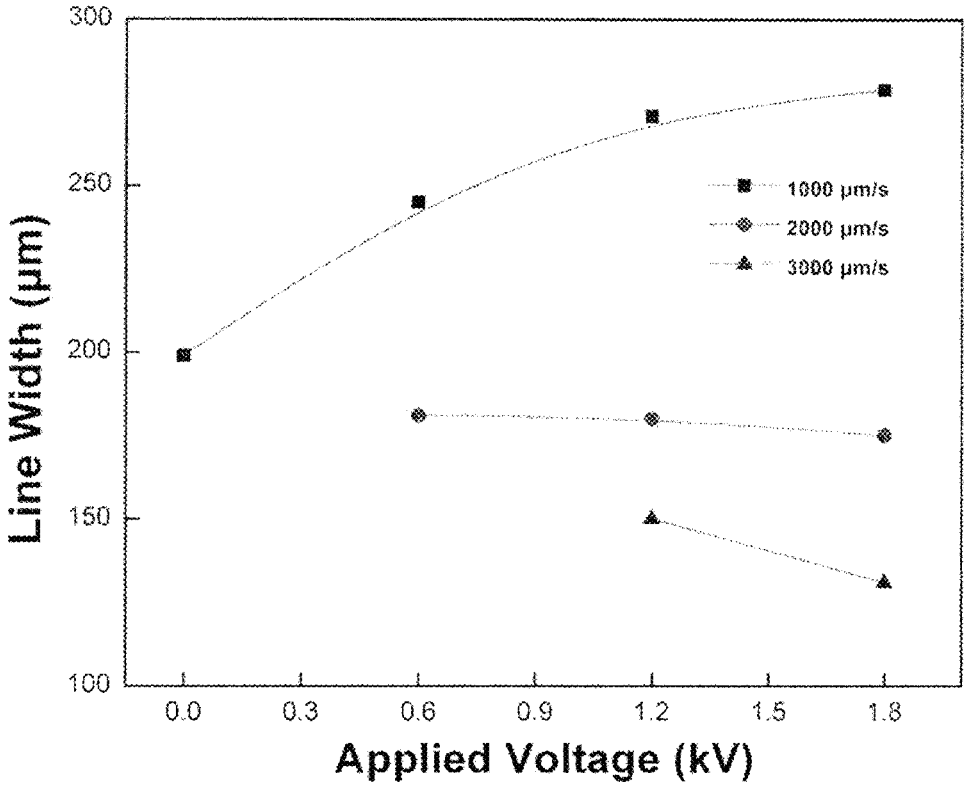
FIG. 6 is a graph schematically illustrating a result of patterning with a fluid of a high viscosity of 10,000 cp in the contact patterning apparatus of FIG. 1.
Figure 7:
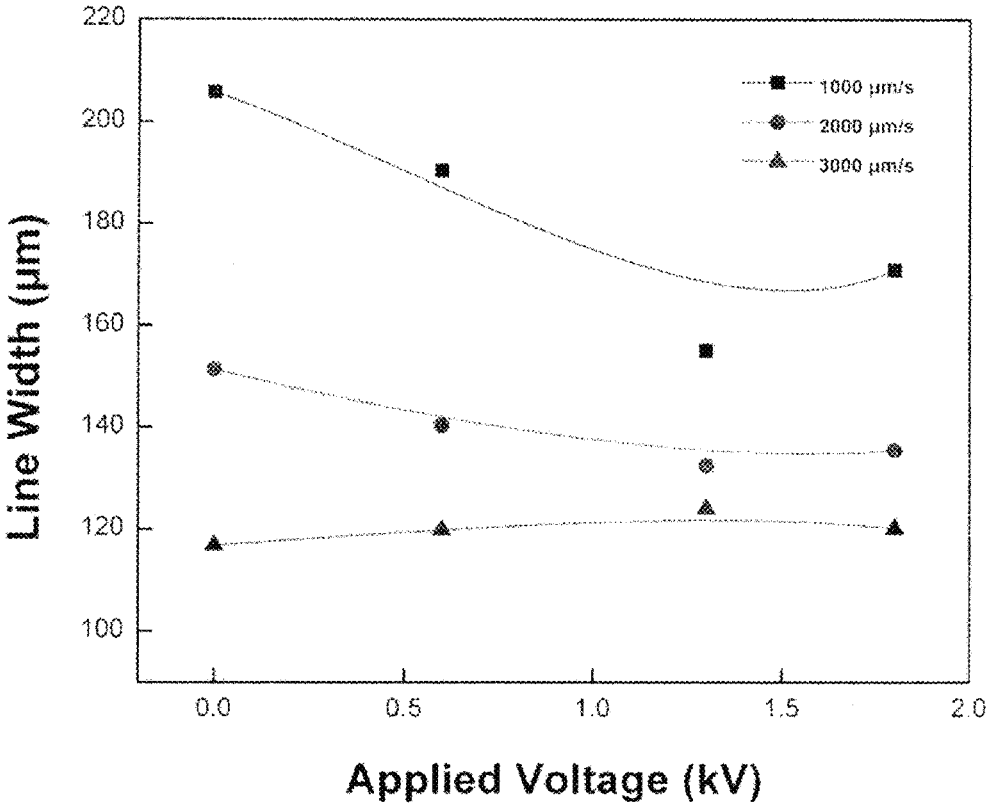
FIG. 7 is a graph schematically illustrating a result of patterning with a fluid of a low viscosity of 1,000 cp in the contact patterning apparatus of FIG. 1.
Figure 8:
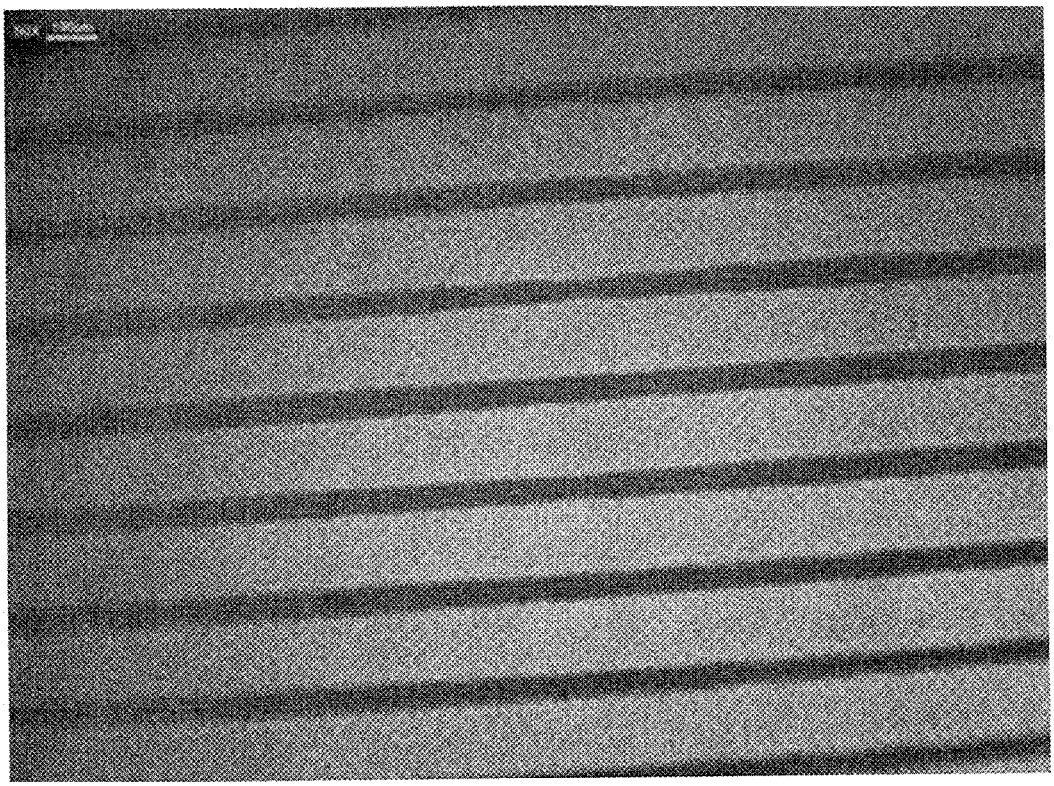
FIG. 8 is a photograph of a result of performing a patterning operation through the contact patterning apparatus of FIG. 1.

FIG. 6 is a graph schematically illustrating a result of patterning with a fluid of a high viscosity of 10,000 cp by the contact patterning apparatus of FIG. 1; FIG. 7 is a graph schematically illustrating a result of patterning with a fluid of a low viscosity of 1,000 cp by the contact patterning apparatus of FIG. 2; and FIG. 8 is a photograph of a result of patterning by the contact patterning apparatus of FIG. 1.

Referring to FIG. 6, a high viscosity fluid with a viscosity of about 10,000 cp and a low viscosity fluid with a viscosity of about 1,000 cp are used.

In the case of patterning a line with the high viscosity fluid at a low patterning velocity, due to the electric stress, more fluid was jetted, and as the level of the voltage increased, the line width increased as well. But when patterning at an increased velocity, as the level of the voltage increased, the line width decreased.

More specifically, in the case where the relative velocity between the substrate (S) and the fluid supply unit 110 was 1000 μm/s, as the level of the voltage increased from 0 kV to 1.8 kV, the width of the line being patterned increased from 200 μm to about 270 μm.

Herein, when the relative velocity between the substrate (S) and the fluid supply unit 110 was adjusted to 2000 μm/s, the width of the line being patterned was maintained at about 170~180 μm regardless of changes in the level of the voltage.

Furthermore, when the relative velocity between the substrate (S) and the fluid supply unit 110 was adjusted to 3000 μm/s, as the level of the voltage increased, the width of the line being patterned decreased from 150 μm to 130 μm.

Referring to FIG. 7, in the case of using the low viscosity fluid, it was difficult to form a continuous line pattern unless a voltage was applied, and even with a voltage applied, the width of the line being patterned tended to decrease. Moreover, above a certain velocity, increasing the voltage level showed a limited effect.

More specifically, when the relative velocity between the substrate (S) and the fluid supply unit 110 was 1000 μm/s, as the level of the voltage increased from 0 kV to 1.8 kV, the width of the line being patterned decreased from about 210 μm to 170 μm.

Herein, when the relative velocity between the substrate (S) and the fluid supply unit 110 was adjusted to 2000 μm/s, the width of the line being patterned decreased from 150 μm to 140 μm regardless of changes in the voltage level.

Furthermore, when the relative velocity between the substrate (S) and the fluid supply unit 110 was adjusted to 3000 μm/s, as the voltage level increased, the width of the line being patterned was maintained at about 120 μm.

Referring to FIG. 8, one can see that it is possible to stably form a continuous line pattern through the contact patterning apparatus according to the first embodiment of the present disclosure.

Next, a contact patterning apparatus according to a second embodiment of the present disclosure will be explained.

Figure 9:
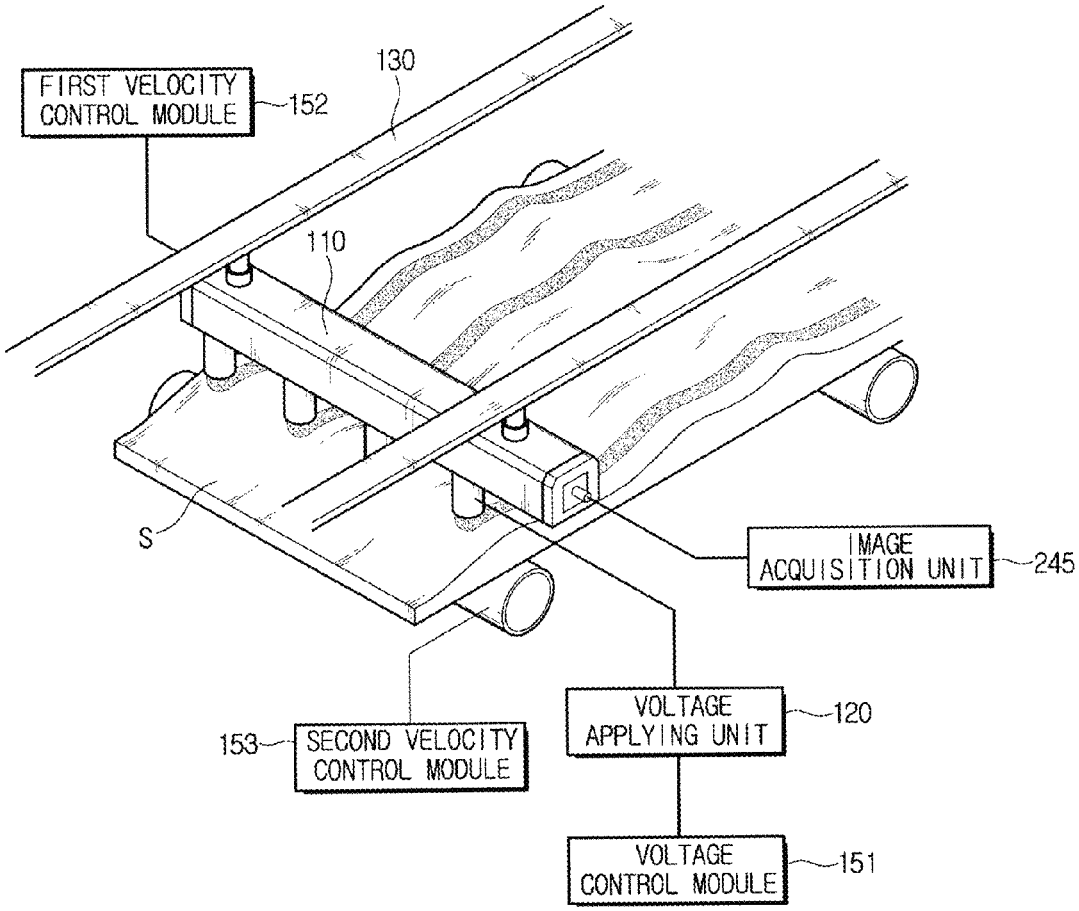
FIG. 9 is a perspective view schematically illustrating a contact patterning apparatus according to a second embodiment of the present disclosure.
Figure 10:
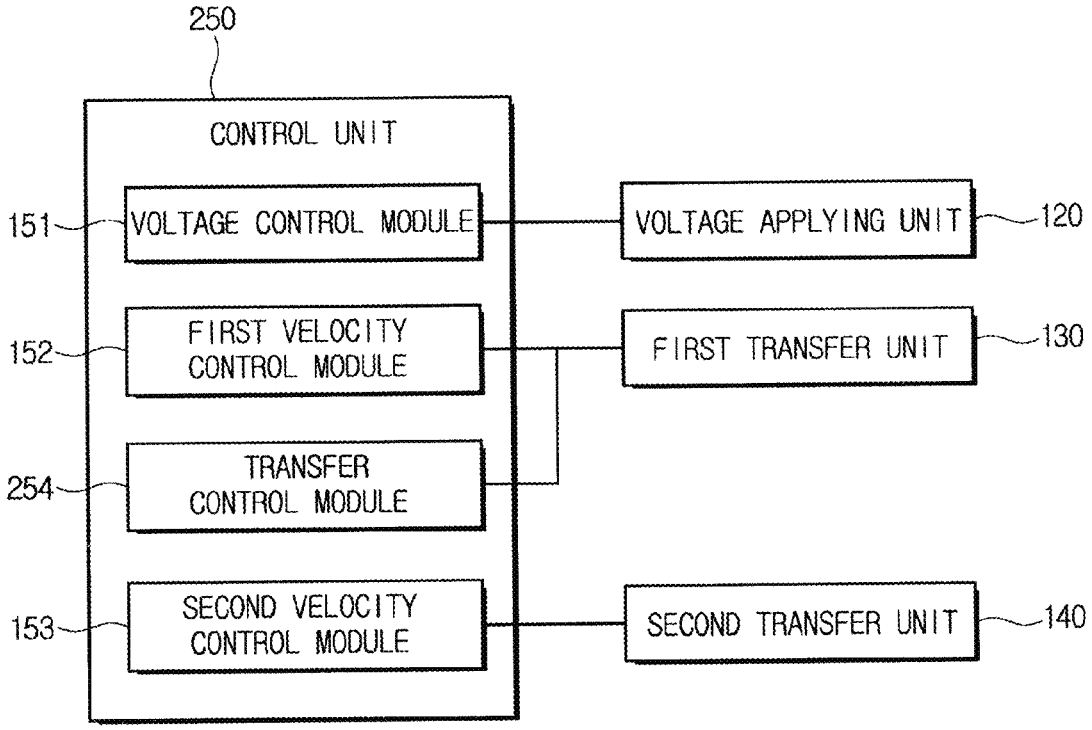
FIG. 10 is a conceptual view schematically illustrating a control unit in the contact patterning apparatus of FIG. 9.

FIG. 9 is a perspective view schematically illustrating the contact patterning apparatus according to the second embodiment of the present disclosure, and FIG. 10 is a conceptual view schematically illustrating a control unit of the contact patterning apparatus of FIG. 9.

Referring to FIG. 9 or FIG. 10, the contact patterning apparatus according to the second embodiment of the present disclosure 200 is configured to pattern a continuous line on a substrate of which the surface is not flat while maintaining a state of the fluid supplied from the fluid supply unit contacting the substrate. This contact patterning apparatus 200 includes a fluid supply unit 110, a voltage applying unit 120, a first transfer unit 130, a second transfer unit 140, an image acquisition unit 245, and a control unit 250.

Before explaining the contact patterning apparatus according to the second embodiment of the present disclosure 200, it is to be noted that the surface of the substrate (S) subject to printing in the second embodiment of the present disclosure is not flat but has a 3-dimensional shape including curve.

The fluid supply unit 110, the voltage applying unit 120, the first transfer unit 130 and the second transfer unit 140 are the same as explained with reference to the first embodiment of the present disclosure, and thus detailed explanation is omitted herein.

The image acquisition unit 245 is configured to acquire information on the shape of the substrate (S) surface and to store the same. The image acquisition unit 245 is connected to the control unit 250 to be explained hereinafter, and provides the image information on the shape of the substrate (S) surface stored therein to the control unit 250.

The second embodiment of the present disclosure adopts a method of patterning a continuous line and at the same time measuring and storing information on the shape of the substrate (S) surface in real time. But, there is no limitation to the above. Thus, the information on the shape of the substrate (S) surface may be acquired and stored before a patterning process is performed.

Meanwhile, vision sensors such as a displacement sensor, touch sensor, capacitive sensor, infrared ray sensor, interferometer and the like may be used for sensing the information on the shape of the substrate (S) surface. But, there is no limitation to the above. Thus, it is a matter of course that any conventional sensor capable of measuring a 3-dimensional surface may be used.

The control unit 250 is configured to adjust the level of the voltage being applied from the voltage applying unit 120, and to receive the information on the shape of the substrate (S) surface from the image acquisition unit 245 and to control the first transfer unit 130, so that the fluid provided from the discharge unit 111 may be patterned in a continuous line form. The control unit 250 includes a voltage control module 151, first velocity control module 152, second velocity control module 153, and transfer control module 254.

The voltage control module 151, the first velocity control module 152, and the second velocity control module 153 are the same as in the first embodiment, and thus detailed explanation will be omitted herein.

The transfer control module 254 receives the information on the shape of the substrate (S) surface from the image acquisition unit 245, and controls the movement of the first transfer unit 130.

Especially, of the information on the shape of the substrate (S) surface, the transfer control module 254 receives information on the height of the substrate (S) surface, and controls the first transfer unit 130 through the transfer control module 254 to adjust the distance between the fluid supply unit 110 and the substrate (S), thereby maintaining the contact state between the meniscus (M) and the substrate (S).

The scope of rights of the present disclosure is not defined by the aforementioned embodiments but in variety of formats within the scope of the claims attached hereto and their equivalents. It will be apparent to one of ordinary skill in the art that various changes in form and details may be made in these examples without departing from the spirit and scope of the claims and their equivalents.

INDUSTRIAL FEASIBILITY

Provided herein is a contact patterning apparatus capable of improving the contact retention force between the substrate and the fluid using the voltage being applied to the fluid between the substrate and the fluid supply unit, thereby stably patterning a continuous line with a fine line width regardless of the viscosity of the fluid used and the patterning velocity.

What is claimed is:

1. A contact patterning apparatus comprising:

a substrate;

a fluid supply unit configured to supply fluid towards the substrate;

a voltage applying unit electrically connected to the fluid supply unit, and configured to make the fluid from the fluid supply unit connected between the substrate and the fluid supply unit by applying a voltage to a surface of the fluid; and a control unit configured to adjust a level of the voltage being applied to the fluid such that the fluid is patterned on the substrate in a dots form or a continuous line form.

2. The apparatus according to claim 1, wherein the substrate and the fluid supply unit are arranged such that they are movable, and the control unit controls the fluid to form a meniscus at one end of the fluid supply unit and selectively controls the fluid to be connected or disconnected between the substrate and the fluid supply unit when the substrate or the fluid supply unit moves, by adjusting the level of the voltage being applied from the voltage applying unit.

3. The apparatus according to claim 2, wherein the control unit is configured to adjust the voltage being applied from the voltage applying unit such that an electric stress generated on a surface of the meniscus, a surface tension generated on the surface of the meniscus, and a friction force generated by a viscosity between the substrate and the meniscus are interacted with one another, thereby the fluid being patterned on the substrate in a dots form or a continuous line form.

4. The apparatus according to claim 2, further comprising a first transfer unit configured to transfer the fluid supply unit towards or away from the substrate, or in parallel to the substrate, wherein the control unit further comprises a first velocity control module configured to control a movement velocity of the first transfer unit.

5. The apparatus according to claim 4, further comprising an image acquisition unit configured to store three-dimensional surface information of the substrate, wherein the control unit further comprises a transfer control module configured to receive the surface information of the substrate from the image acquisition unit and to control a movement of the first transfer unit.

6. The apparatus according to claim 2, further comprising a second transfer unit configured to move the substrate, wherein the control unit further comprises a second velocity control module configured to control a movement velocity of the second transfer unit.

7. The apparatus according to claim 1, wherein the fluid supply unit is a nozzle configured to spray the fluid in an electrohydrodynamic inkjet method.

8. The apparatus according to claim 7, wherein the fluid supply unit has an internal diameter of not more than 100 μm, and the distance between the fluid supply unit and the substrate is not more than 50 μm.

9. The apparatus according to claim 2, wherein the fluid supply unit is provided with a plate; and a nano tip installed in a lower part of the plate, and of which the cross-section decreases towards a lower side of the nano tip.

10. The apparatus according to claim 9, wherein a through-groove is formed on an upper surface of the nano tip, and the plate is provided with a horizontal flow path that is internally-recessed from an upper surface of the plate and that is connected to the through-groove.

11. The apparatus according to claim 9, wherein the nano tip is installed at one end of the plate, the plate is provided with a horizontal flow path that is inwardly-recessed from an upper surface of the plate and that extends to the end of the plate, and the nano tip is provided with a vertical flow path that is inwardly-recessed from an exterior surface of the nano tip and that is connected to the fluid flow path and extends to the lower end of the nano tip.

12. The apparatus according to claim 1, further comprising a case unit configured to accommodate therein the substrate and the fluid supply unit.

13. The apparatus according to claim 12, further comprising a gas storage configured to supply at least one of nitrogen and inert gas to the inside of the case unit.

14. The apparatus according to claim 2, wherein the distance between the fluid supply unit and the substrate is not more than 0.5 times the diameter of the meniscus.

15. The apparatus according to claim 3, wherein the distance between the fluid supply unit and the substrate is not more than 0.5 times the diameter of the meniscus.

16. The apparatus according to claim 4, wherein the distance between the fluid supply unit and the substrate is not more than 0.5 times the diameter of the meniscus.

17. The apparatus according to claim 5, wherein the distance between the fluid supply unit and the substrate is not more than 0.5 times the diameter of the meniscus.

18. The apparatus according to claim 6, wherein the distance between the fluid supply unit and the substrate is not more than 0.5 times the diameter of the meniscus.

19. The apparatus according to claim 9, wherein the distance between the fluid supply unit and the substrate is not more than 0.5 times the diameter of the meniscus.

20. The apparatus according to claim 10, wherein the distance between the fluid supply unit and the substrate is not more than 0.5 times the diameter of the meniscus.

* * * * *